US006262646B1

(12) United States Patent
Van Zeeland

(10) Patent No.: US 6,262,646 B1
(45) Date of Patent: Jul. 17, 2001

(54) ISLAND SWITCH

(75) Inventor: Anthony J. Van Zeeland, Mesa, AZ (US)

(73) Assignee: Duraswitch Industries, Inc., Mesa, AZ (US)

( * ) Notice: Subject to any disclaimer, the term of this patent is extended or adjusted under 35 U.S.C. 154(b) by 0 days.

(21) Appl. No.: 09/420,230

(22) Filed: Oct. 18, 1999

(51) Int. Cl.[7] ..... H01H 9/00
(52) U.S. Cl. ..... 335/205; 200/521
(58) Field of Search ..... 335/205–7; 200/521, 200/5 A, 519–520, 404

(56) References Cited

U.S. PATENT DOCUMENTS 3,167,624 * 1/1965 Jones, Jr. ..... 335/205
3,681,723 * 8/1972 Goll ..... 335/205
4,409,450 * 10/1983 Blades ..... 200/5 A
4,463,234 * 7/1984 Bennewitz ..... 200/5 A
4,499,343 * 2/1985 Prioux et al. ..... 200/5 A
5,121,091 * 6/1992 Fujiyama ..... 335/209

* cited by examiner

*Primary Examiner*—Lincoln Donovan
(74) *Attorney, Agent, or Firm*—Cook, Alex, McFarron, Manzo, Cummings & Mehler, Ltd.

(57) ABSTRACT

A magnetically actuated pushbutton switch has individual switch modules pre-assembled as standalone subassemblies. Each subassembly has a platform with a cavity on its underside. A portion of the platform is magnetized. A metallic armature is held in the cavity by the magnetic attraction of the platform. The switch subassemblies are mounted on a substrate that has switch contacts thereon. The armature is movable into and out of shorting relation with the contacts. A major spacer on the substrate has openings aligned with the switch contacts for receiving the subassemblies. An overlay film covers the subassemblies and major spacer. The armature may have a lens therein for transmitting backlighting. The platform can be magnetized at the time of installation on the substrate.

31 Claims, 8 Drawing Sheets

ISLAND SWITCH

BACKGROUND OF THE INVENTION

Magnetically actuated pushbutton switches have a metal armature normally held spaced from switch contacts by a magnet. Pushing on the armature causes it to snap free of the magnet and close the switch contacts by shorting them. Release of the actuating pressure allows the magnetic force to withdraw the armature from the contacts to reopen the switch. The switches typically are made in panels having a non-conductive substrate with electrical contacts formed thereon. A non-conductive spacer layer lies on the substrate with openings therein exposing the contacts. A sheet magnet overlies the spacer with the armatures underneath the magnet layer in the spacer openings. The armatures preferably have actuating buttons that protrude through apertures in the magnet layer. Most often the magnet layer itself is covered by a membrane or the like, the upper surface of which carries suitable graphics. The benefits of magnetically-actuated pushbutton switches have been demonstrated in U.S. Pat. Nos. 5,523,730, 5,666,096, 5,867,082 and 5,990,772, the disclosures of which are incorporated herein by reference.

Although the pushbutton switch as shown and described in the foregoing patents is very robust and easy to manufacture, relative to its counterparts, certain improvements in the manufacturing process are addressed by the present invention. The most difficult and expensive process in the manufacture of the described pushbutton switches is assembling all of the individual layers consistently. This can be a problem around the individual switch areas where the alignment with the armature is critical. Using pins to align the individual layers relative to each other is adequate to assemble a magnetically actuated pushbutton switch, although it is most advantageously done with special assembly apparatus. Tolerances are always a problem, however. As the overall size of the switch panel increases, the tolerances become difficult to control. The present invention teaches an alternative method of construction to eliminate the problems with assembly and to significantly reduce the overall product cost.

SUMMARY OF THE INVENTION

The present invention concerns a magnetically actuated pushbutton switch wherein each switch includes a pre-assembled, free-standing actuator subassembly. Because each subassembly is separate from the others on a switch panel, they are sometimes referred to herein as island modules. The subassembly is made up of a platform which defines a cavity on its underside. The platform can be either stratified or monolithic. At least a portion of the platform is magnetized. A metallic armature fits into the cavity and is held therein by the magnetic attraction of the magnetized portion of the platform. The stratified platform may comprise a local spacer having a local opening therein, and a coupler which is a magnet. The coupler may have an aperture that allows an actuating button formed on the armature to protrude and receive the actuating force. An upper spacer may surround the protruding button to provide a top surface for supporting a membrane or overlay. The alternate, monolithic platform is formed as a single, integral component. Magnetization of the monolithic platform can take place immediately prior to installation of the subassembly.

The actuator subassemblies are mounted on a substrate. The substrate carries electrodes which include at least one set of switch contacts. In some applications it may be desirable to place a major spacer over the substrate with openings in the major spacer aligned with the switch contacts. The actuator subassemblies are then placed into these openings to complete the switch. The armature may be provided with a lens to disperse backlighting. Tactile domes may be added to the actuator subassemblies. The subassemblies may have multiple armatures.

DETAILED DESCRIPTION OF THE INVENTION

Figure 1:
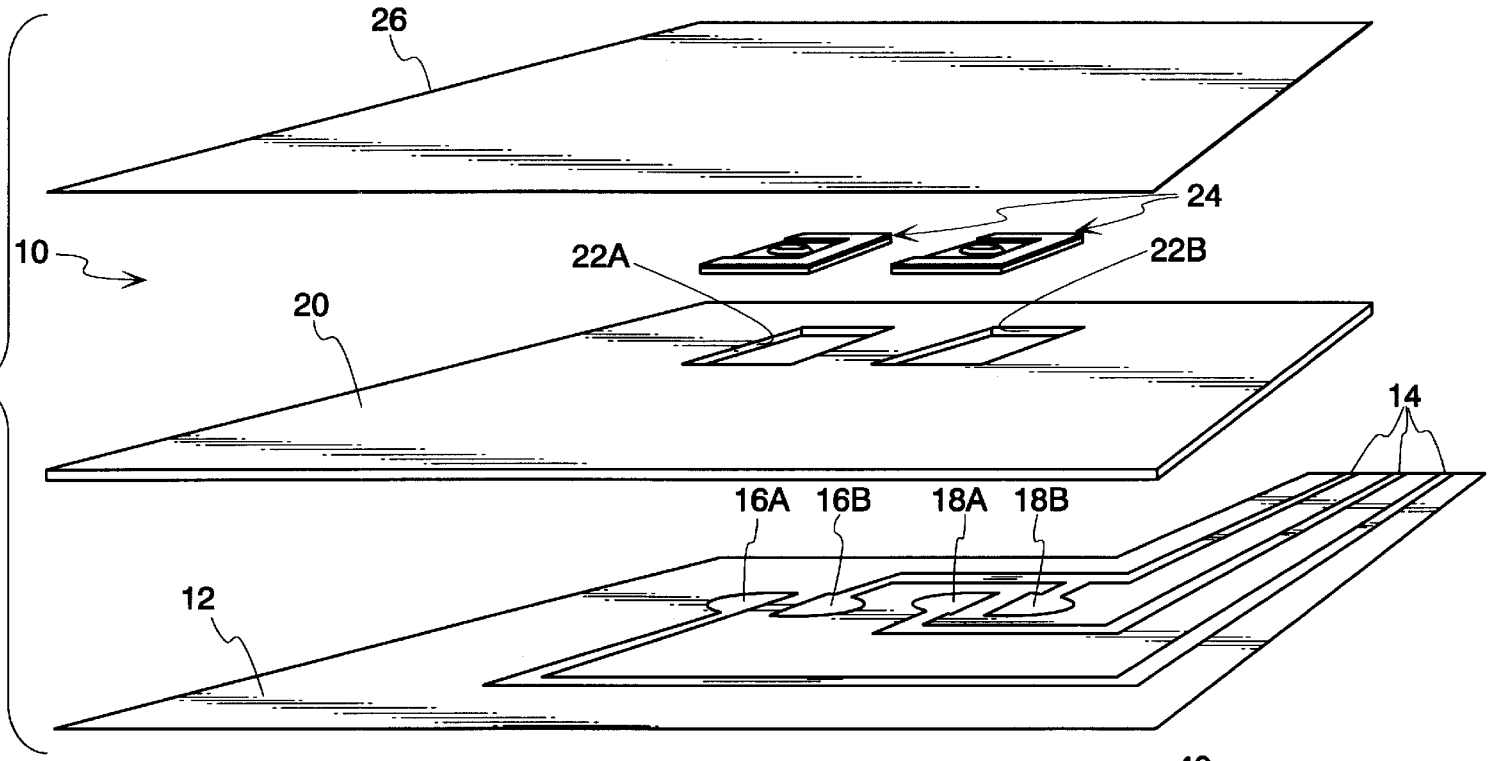
FIG. 1 is an exploded perspective view of a full switch panel according to the present invention.

FIG. 1 illustrates a switch panel 10 according to the present invention. The panel includes a substrate 12 which is formed of either rigid or flexible non-conductive material. For example, the substrate can be made of printed circuit board material or plastic film such as polyester. At least one surface of the substrate has electrodes formed thereon by a suitable process such as etching or screen printing. Electrodes can be arranged in any suitable manner and will typically include leads 14 which extend to an appropriate connector portion at an edge of the substrate. The electrodes will also include sets of spaced switch contacts such as the pads shown at 16A, 16B and 18A, 18B. As can be seen, the switch contacts 16, 18 are suitably connected to various ones of the leads 14 and the contacts themselves are spaced apart. It will be understood that the electrodes and contacts can be arranged in any configuration needed. For example, instead of the simple pads shown at 16 and 18, a more complex arrangement of spaced, interleaved fingers could be used.

A major spacer 20 is mounted on the substrate 12. The spacer is made of a thick film or rigid material, preferably with adhesive located on the top and bottom surfaces. A typical material used in this application would be closed cell adhesive foam such as one manufactured by 3M Corporation and sold under their trademark VHB Series. This material is supplied with a high bond adhesive on both the top and bottom surfaces. Release liners cover the adhesive layers prior to assembly. One advantage of using closed cell foam as a spacer is that the flexibility of the material allows the adhesive to bond readily with the substrate, even if it has a rough surface. Typical imperfections on the surface would be conductive traces such as the screened silver or etched copper leads 14. The closed cell foam material protects the switch from liquids and gases and allows the assembly to be sealed. While the use of adhesive is the preferred method of joining the major spacer and substrate, mechanical means could be used, either alone or in combination with adhesive.

The major spacer 20 has openings such as at 22A and 22B formed therein and located so as to expose the sets of contacts on the substrate. Thus, opening 22A is aligned with the switch contacts 16 while opening 22B is aligned with and exposes contacts 18. Individual island modules or actuator subassemblies 24 fit into the openings 22. Details of the subassemblies 24 will be described below. Miscellaneous components can also be pre-assembled on to the substrate 12. When such components are included, holes similar to openings 22A or 22B are cut into the major spacer to accommodate these components. This is shown in more detail in FIGS. 9 and 10.

After insertion of the switch subassemblies 24 into openings 22A or 22B, release liners, if present, are removed from the top surfaces of the major spacer 20 and the subassemblies 24. A top film layer or membrane 26 is placed over the major spacer and actuator subassemblies 24. The film layer 26 is made of flexible plastic or elastomeric material. It can have suitable graphics printed thereon to instruct a user as to the location of a switch subassembly. The film layer adheres to the major spacer 20 and, optionally, to the top of the subassemblies 24. As mentioned above, mechanical methods may also be used to secure the film layer 26.

Figure 4:
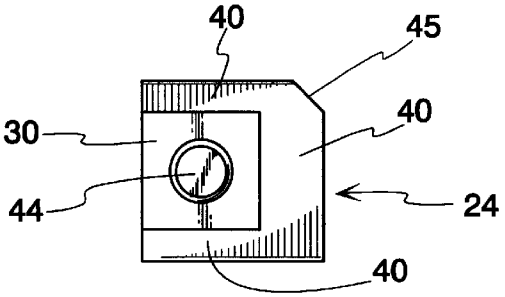
FIG. 4 is a top plan view of the subassembly.
Figure 2:
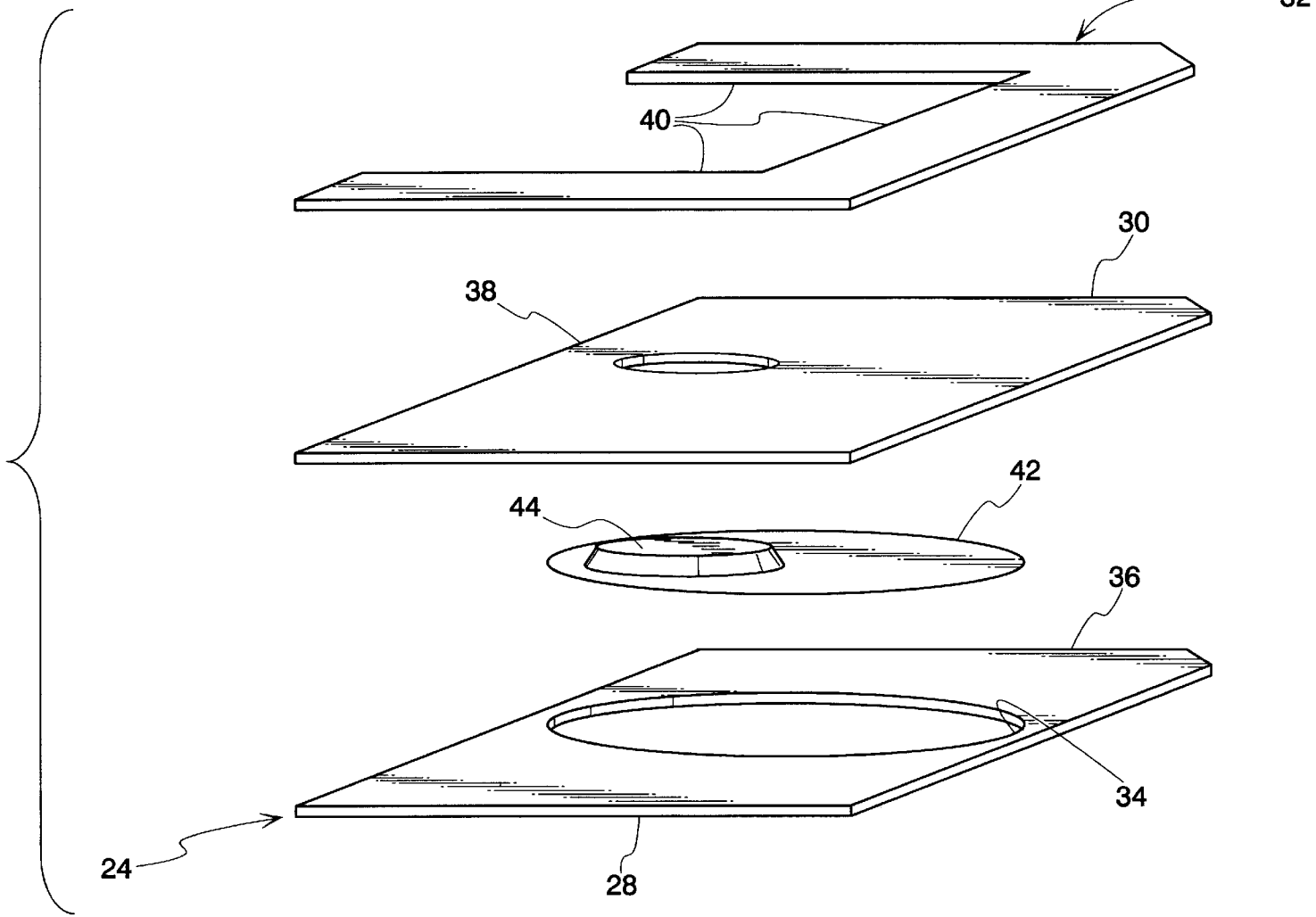
FIG. 2 is an exploded perspective view of an actuator subassembly.
Figure 3:
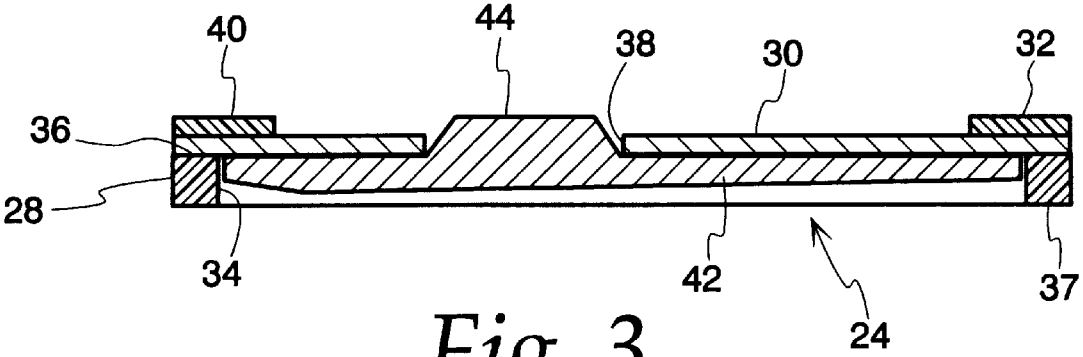
FIG. 3 is a section through the completed subassembly of FIG. 2.

Looking now at FIGS. 2–4, details of the actuator subassembly or island module 24 will be described. Each subassembly has two major components, a platform and an armature. The platform defines a cavity for receiving the armature. The embodiment of FIGS. 2–4 shows a stratified platform which includes a local spacer 28, a coupler 30 and an upper spacer 32. The local spacer 28 is made of non-conductive material such as polyester. It has a local opening 34, an upper surface 36 and a lower surface 37. The local opening 34 extends all the way through the thickness of the local spacer. The coupler 30 also has an aperture 38 all the way through its thickness. The coupler is a sheet magnet. Together the coupler 30 and the local spacer 28 define a cavity in the area of the local opening 34. The upper spacer 32 has three legs 40 forming three sides of a rectangle and defining an open area which surrounds the coupler aperture 38. The parts of the stratified platform may be held together by adhesive (not shown). Thus, adhesive may be deposited on the top and bottom sides of the upper spacer 32 and on the top surface 36 and the lower surface 37 of the local spacer 28. Release liners may cover any of these adhesive layers until such time as joining with adjacent members is desired. For example, the lower surface 37 of the local spacer would have a release liner that would remain in place until it is time for the subassembly 24 to be mounted on the substrate 12. If adhesive is used on the top of the upper spacer, a release liner thereon would be removed just prior to installation of the film layer 26.

The second major component of the actuator subassembly 24 is an armature 42. It is made of electrically conductive, magnetic material, i.e., material that is affected by a magnet. Typically the armature is soft steel. The armature shown has a disc-like configuration with an upstanding or protruding actuating button 44 formed on one side of the disc. The actuating button protrudes through the aperture 38 in the coupler 30. The actuating button extends above the top surface of the coupler to the same extent as the thickness of the upper spacer 32. Thus, the top of the button 44 and top of the upper spacer 32 terminate in the same plane. This provides a smooth, level surface for the top film layer 26. Alternately, the button 44 could extend above the upper spacer 32 and cause a slight bulge in the film layer to provide a visual and tactile indication of the button's location.

The subassembly 24 is placed on the substrate 12 by removing the release liner from the bottom surface 37 of the local spacer 28 and pressing the subassembly into the appropriate opening 22 in the major spacer 20. Once that is done the armature 42 will reside above the switch contacts 16 or 18. It will be noted in FIG. 4 that one comer of the subassembly may be beveled as at 45. The major spacer opening 22 is similarly shaped. This affords a nonsymmetrical configuration that prevents putting the subassembly in backwards.

When a user presses on the actuating button 44 it causes the left side (as viewed in FIG. 3) of the armature to break away from the coupler 30 until the left side of the armature bottoms on the switch contact pad, e.g. 16A. Continued actuating pressure then causes the right side of the armature to break away and engage the other contact pad 16B. This shorts the contact pads and closes the switch. Removal of the actuating pressure allows the magnetic force of the coupler 30 to pull the armature 42 back up off of the contacts and into the position shown in FIG. 3 wherein the armature is spaced from the contact pads.

Figure 5:
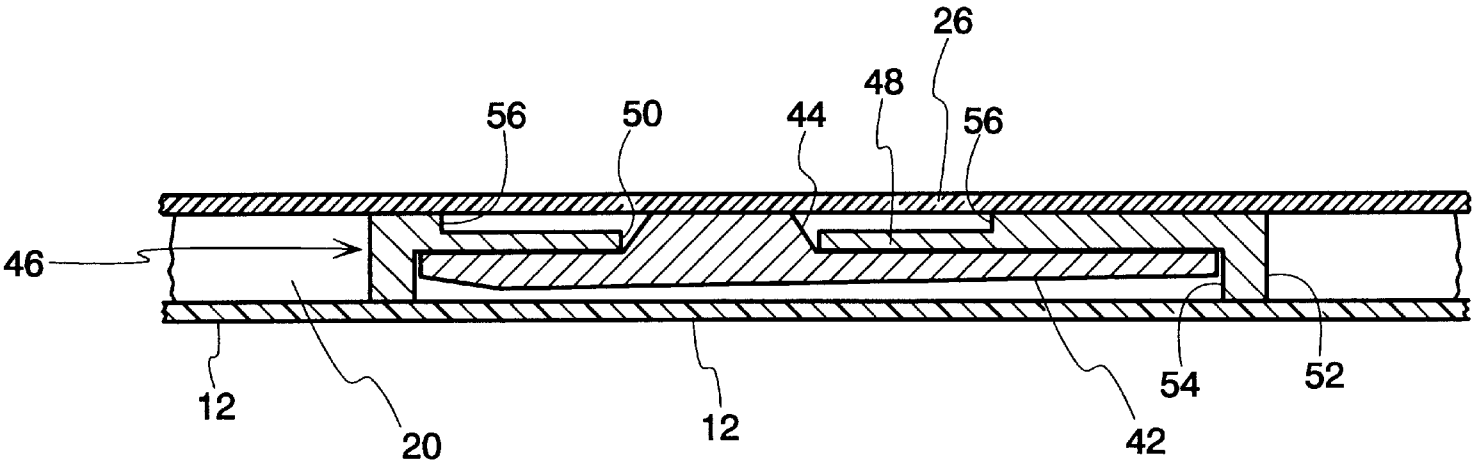
FIG. 5 is a section through an alternate embodiment of a switch panel having a monolithic island module.
Figure 6:
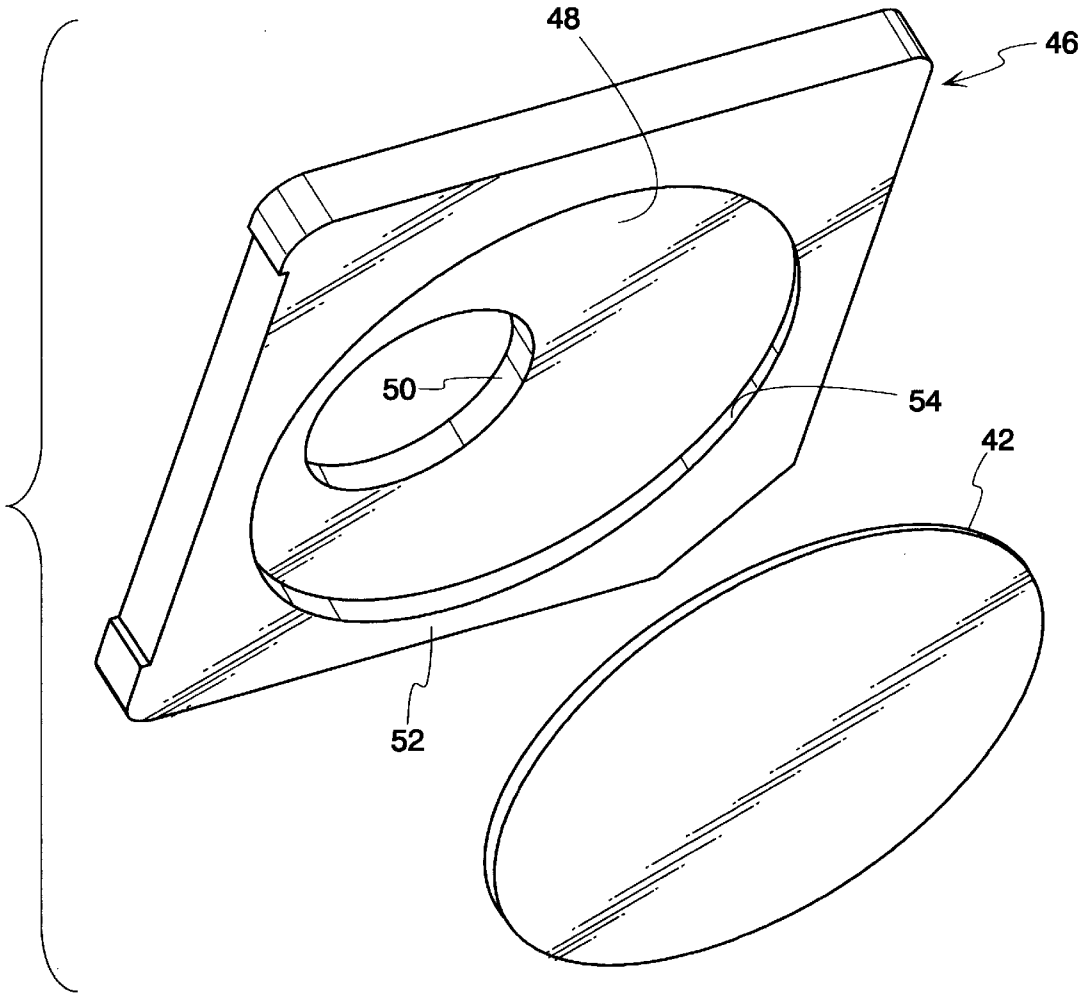
FIG. 6 is an exploded perspective view of the bottom of the monolithic island module.
Figure 7:
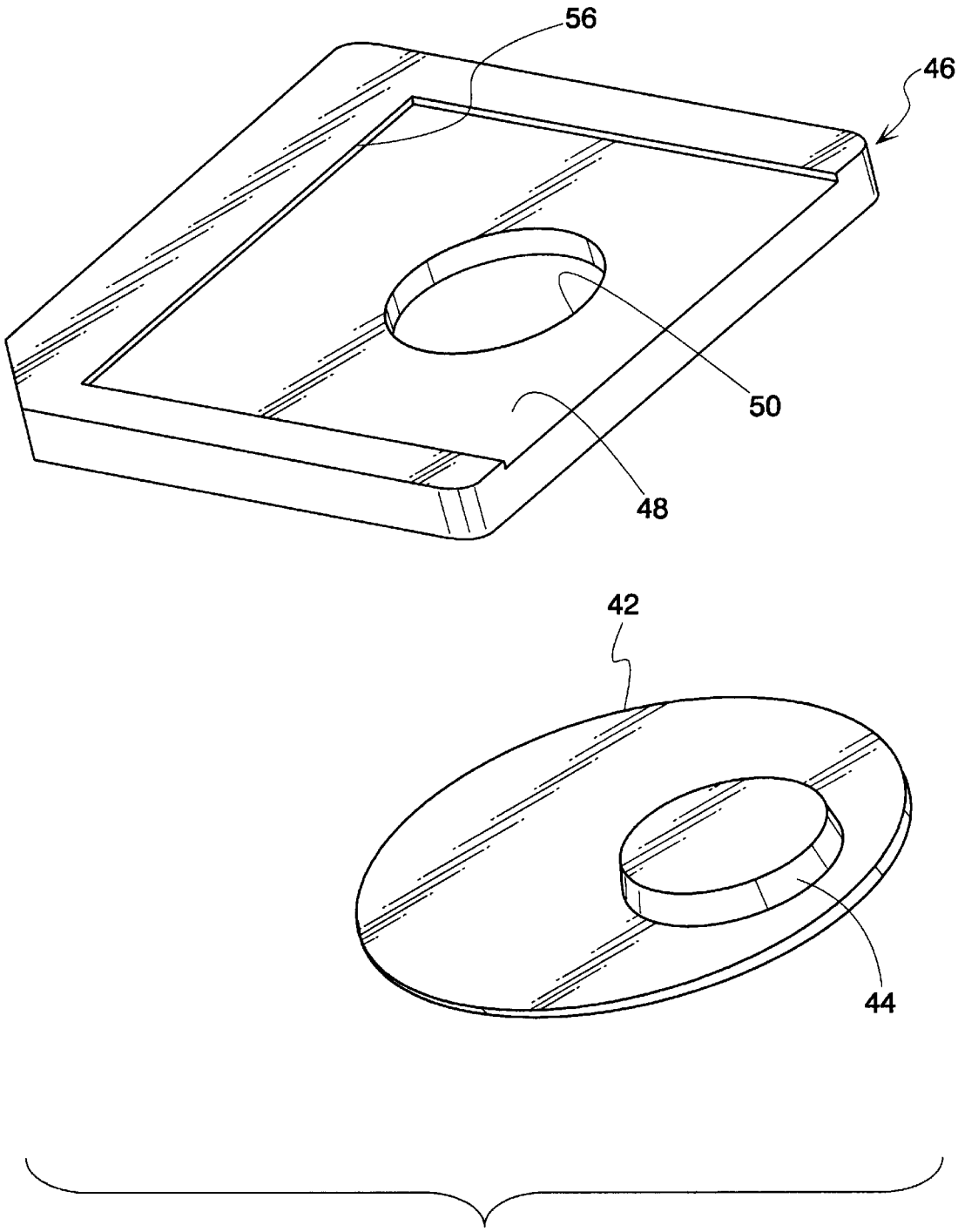
FIG. 7 is an exploded perspective view of the top of the monolithic island module.

An alternate embodiment of the actuator subassembly is shown in FIGS. 5–7. In this embodiment, which may be referred to as a monolithic island module, the platform 46 is made as a single, integral part. It includes a coupler layer 48 having an aperture 50 therethrough. The underside of the coupler 48 has a rim 52 around its perimeter. The rim defines a depression or cavity 54 in which the armature 42 sits. The top side of the coupler 48 has an upper spacer 56 around three side edges. The armature 42 resides in the cavity 54 with its actuating button 44 extending through the aperture 50. It can be seen that the monolithic platform has just one part compared to the three part stratified platform.

This construction offers a number of advantages in addition to ease of manufacture. For example, the sheet magnet material used in other switches is magnetized in a series of parallel poles of opposite polarity. This makes it difficult to specifically magnetize a particular area to a certain polarity or to increase its magnetic force. The unitary design of the monolithic island module platform allows for the magnetic poles to be placed at very specific points, thus allowing for high magnetic forces to be placed in the position where they will allow for increased and optimum switch actuation force and travel characteristics. Additionally, state of the art sheet magnet materials are limited to relatively low force ferrite magnet materials. The molded construction of this teaching allows the magnets to be fabricated from high magnetic force rare earth materials such as neodymium iron boron and samarium cobalt. In addition, thicker magnets can be fabricated that have greater magnetic induction strengths. Much smaller switches thus can be fabricated since the monolithic platform does not suffer the limitations of prior art products which, at least to some extent, are limited by the overall area of the switch armature and the thickness of the magnet material. Another advantage of the monolithic platform is it can be molded but not magnetized until it is ready for assembly. The platform is magnetized at the time of installation of the substrate, i.e., either just prior to or immediately after installation on a substrate. This timing makes it much easier to keep the platform clean after its fabrication but prior to installation. Also, the unassembled, unmagnetized platforms are easier to handle in containers such as bags or boxes because they don't stick together as much as magnetized components do. Greater control of the magnetic field strength is also possible. The platform could be magnetized with multiple parallel poles or with just two poles.

Figure 8:
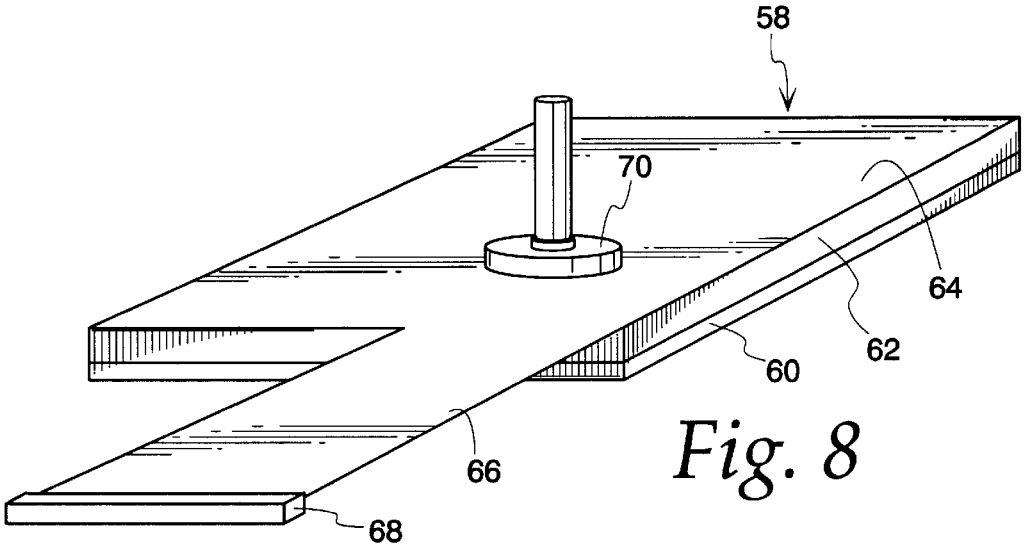
FIG. 8 is a perspective view of a further alternate embodiment of a switch panel having a substrate, major spacer and top film with an integrated rotary switch.
Figure 9:
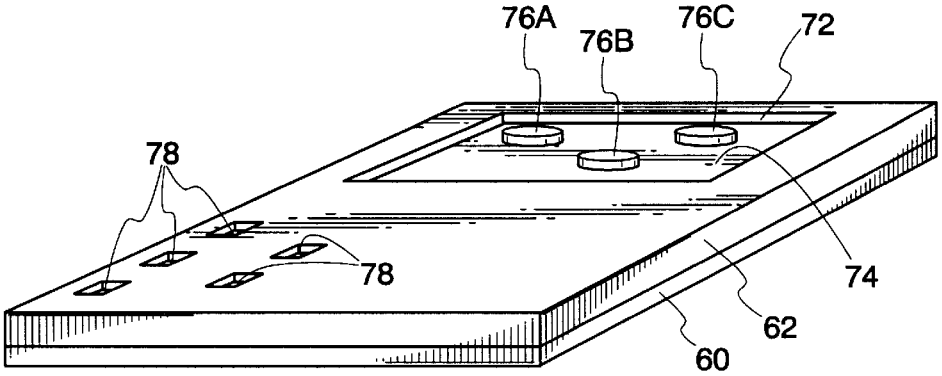
FIG. 9 is a perspective view of the switch panel of FIG. 8 with the top film removed to reveal the major spacer and the multiple armature island module.
Figure 10:
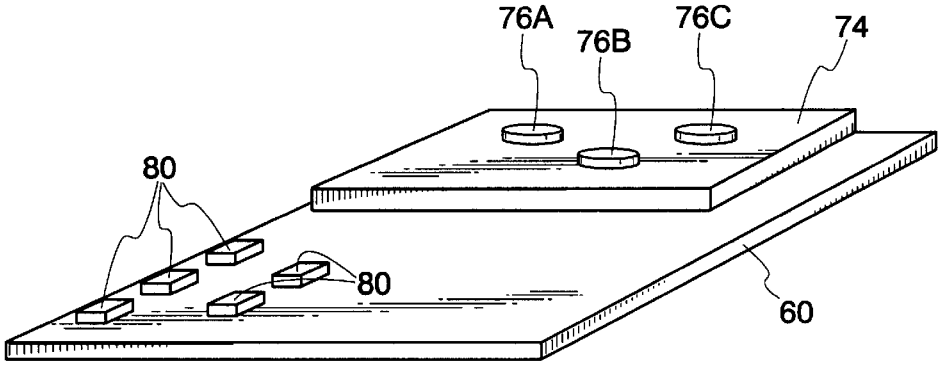
FIG. 10 is a perspective view of the switch panel of FIG. 8 with both the top film and major spacer removed to reveal the substrate.

FIGS. 8–10 illustrate a further variation on the island switch. This switch panel 58 comprises a substrate 60, a major spacer 62 and a top film layer 64. These may be made of materials similar to those of the FIG. 1 embodiment. The top film layer may have a tail 66 that extends to a connector 68 for attachment to an associated electronics unit (not shown). The top film has conductors on its underside as needed to create a rotary switch. The switch rotor is shown at 70. Further details of the rotary switch are shown in U.S. Pat. No. 5,867,082. FIG. 9 illustrates the major spacer 62 and a large opening 72 therein which accommodates a multiple-armature island switch module. This module has a platform 74 that has three cavities underneath it for receiving three separate armatures 76A, 76B and 76C. The platform 74 fits within opening 72. The major spacer 62 also has a plurality of smaller openings 78. These accommodate surface mounted components such as those illustrated diagrammatically at 80 in FIG. 10. These components are mounted on the printed circuit board that forms the substrate 60. FIG. 10 also shows how the platform 74 rests on the top surface of the substrate 60. It will be understood that the top of the substrate would also have electrodes (not shown) formed thereon to connect to switch contact pads underneath the armatures 76.

Figure 12:
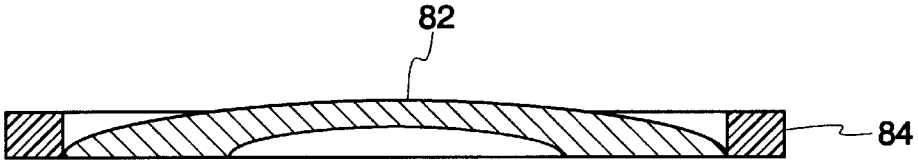
FIG. 12 is a section taken along line 12—12 of FIG. 11.
Figure 11:
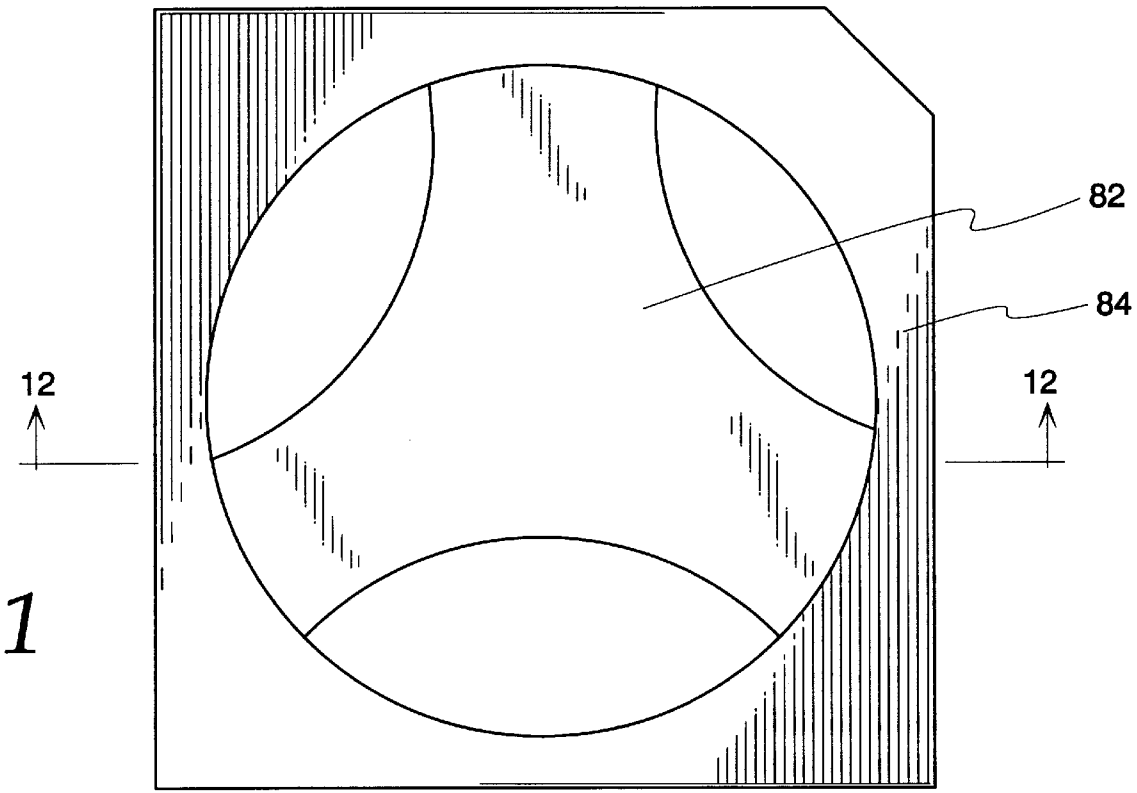
FIG. 11 is a top plan view of a tactile dome.

The island switch modules of FIGS. 2 and 5 are also applicable to a dome switch. For years, the membrane switch industry, and indeed most tactile pushbutton switch manufacturers, have utilized metal or plastic domes to provide tactile feel for their switches. The major problem associated with the tactile dome membrane switches has been repeatability from one switch to another within a switch panel. These inconsistencies are due primarily to inconsistencies in alignment and assembly of the layers. In the present invention, assembly of the dome switches can be automated and the domes can be placed as individual islands, thus eliminating the prior art inconsistencies for all intents and purposes. One example of how such an island would look is shown in FIGS. 11 and 12. A tactile dome 82 is held in place on top of the actuator subassembly by a dome retainer 84. The retainer may be adhesively fixed to the magnet layer 30. The dome may fit within the legs 40 of the upper spacer 32.

Figure 13:
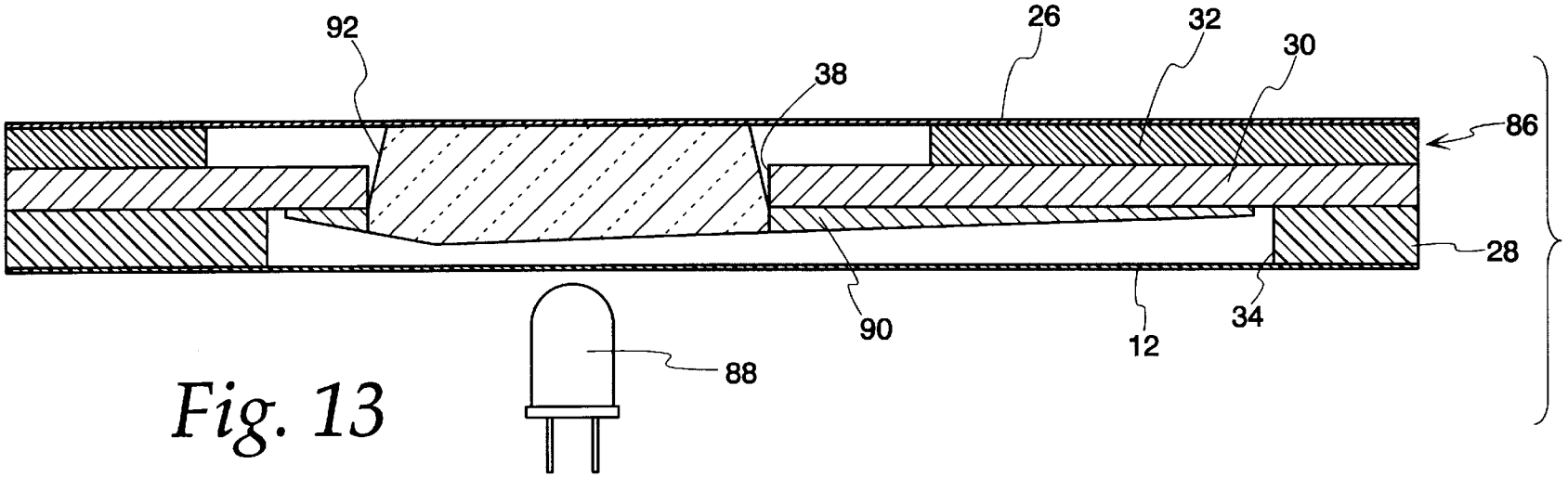
FIG. 13 is a section through a further alternate embodiment of a switch panel having a lens in the armature for transmitting light through the actuator subassembly.
Figure 14:
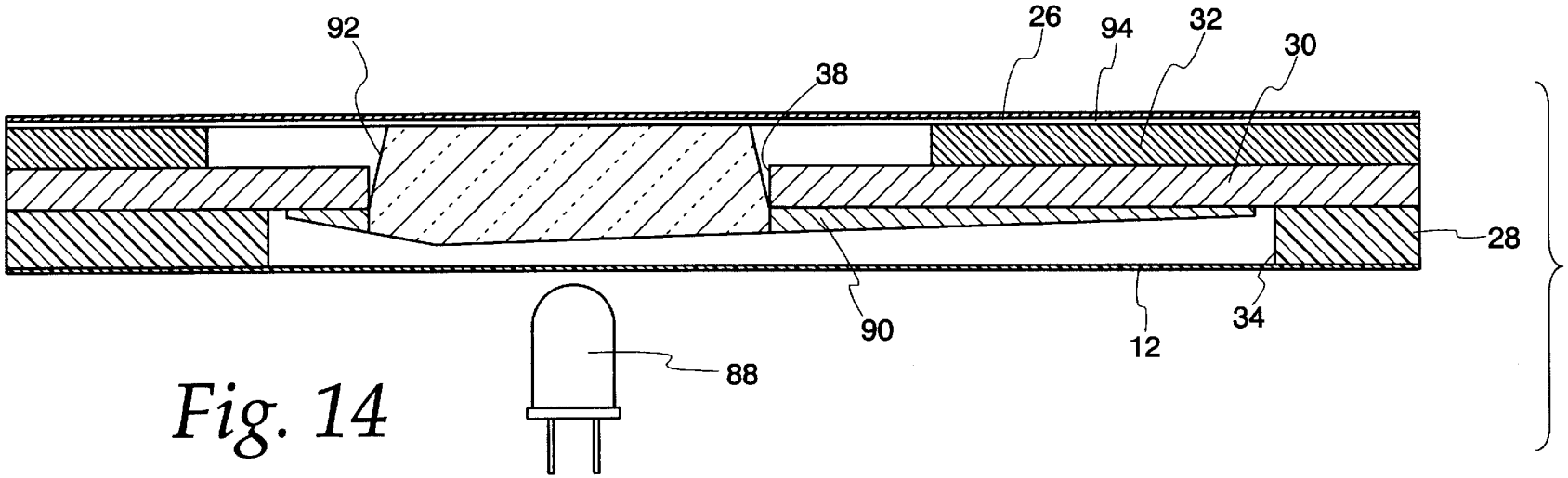
FIG. 14 is a view similar to FIG. 13 showing a further variation.

Looking now at FIGS. 13 and 14, another aspect of the present invention is shown and described. In many switch applications, backlighting of the individual switch positions or modules is required. There are a number of alternative techniques available at the present time for providing lighting. Among these are edge lighting, light pipes and electroluminesence. Each of these various techniques has different degrees of difficulty, cost and limitations. This disclosure offers a unique method of lighting magnetically actuated pushbutton switches. The basic construction is similar to that of the switch panel 10 in FIG. 1 and the actuator subassembly 24 in FIGS. 2 and 3. Common elements are given common reference numbers and their description will not be repeated. The island module shown generally at 86 includes a back light source 88 shown schematically in this example as an LED. It will be understood that the LED is electrically connected to a suitable power source and physically mounted in a suitable housing underneath the substrate 12. The armature 90 has a lens or crystal 92 insert molded as part of the armature. Alternately, the lens 92 can be snapped in place in an opening in the armature. As shown in FIG. 13, the light is piped up from underneath the armature and through either an opening or transparent portion of the substrate 12. Light is scattered at the top surface of the lens 92 through the overlay film 26. This allows the center of the individual switch module to be lighted.

The shape of the lens is important in that the light has to be scattered to provide uniformity across the face of the switch. A faceted design is shown in the figure on the top and bottom surfaces. It is important to note that since the actual switch contacts are not in the center of the lens 92, the switch contact integrity is not compromised, as is often the case with domed or standard membrane switches.

The light scattering can be enhanced by providing a diffraction grating as shown in FIG. 14 at 94. This grating is placed between the overlay film 26 and the upper spacer 32. Alternatively, the diffraction grating could be placed just on top of the lens 92. A diffraction grating is a series of diffracting lines either etched or molded into the surface and extending as concentric rings around the center of the light source. Providing a fluorescing layer on the bottom surface of the top film can enhance the light scattering. This layer is loaded with fluorescing dye and can either be screened on the bottom surface of the overlay or inserted as a separate film.

While a preferred form of the invention has been shown and described, it will be realized that alterations and modifications may be made thereto without departing from the scope of the following claims. For example, while at least a portion of the platform is described as being magnetized and the armature is made of magnetic material, this could be reversed so the armature is a magnet and the platform is magnetic material. Also, while the island switch modules have been described as joined to the substrate by adhesive which is covered by a release liner prior to installation, the modules could be retained by other means not requiring adhesive or release liners.

What is claimed is:

1. An electrical switch, comprising:

a substrate;

electrodes disposed on the substrate and defining at least one set of spaced switch contacts;

a major spacer adjacent to and in contact with the substrate and having an opening aligned with said at least one set of switch contacts;

an actuator subassembly disposed in the opening of the major spacer for selectively opening or closing the switch contacts, the actuator subassembly comprising a platform mounted on the substrate and defining a cavity adjacent the switch contacts and an electrically conductive armature disposed in the cavity, one of the platform and armature including a permanent magnet and the other being made of magnetic material such that the armature is normally held spaced from the switch contacts in engagement with the platform by the magnetic attraction between the platform and armature, the armature being releasable from the platform upon application of a switch closing force to engage and close the switch contacts.

2. The switch of claim 1 wherein the platform comprises:

a local spacer having a local opening therethrough and an upper surface; and a coupler laver mounted on the upper surface of the local spacer and at least partially overlying the local opening such that the coupler and the local spacer define the cavity at the local spacer opening.

3. The switch of claim 1 wherein the platform comprises a local spacer integrally formed with and supporting a coupler in spaced relation to the switch contacts.

4. The switch of claim 1 further comprising an aperture in the platform, and an actuating button on the armature which protrudes at least partially into the aperture.

5. The switch of claim 4 wherein the actuating button protrudes fully through the aperture and further comprising an upper spacer at least partially surrounding the aperture and actuating button.

6. The switch of claim 5 wherein the upper spacer thickness is such that it terminates in the same plane as the protruding portion of the actuating button.

7. The switch of claim 3 further comprising an aperture in the platform, and an actuating button on the armature which protrudes at least partially into the aperture.

8. The switch of claim 7 wherein the actuating button protrudes fully through the aperture and further comprising an upper spacer at least partially surrounding the aperture and actuating button.

9. The switch of claim 8 wherein the upper spacer thickness is such that it terminates in the same plane as the protruding portion of the actuating button.

10. The switch of claim 8 wherein the upper spacer is integrally formed in the upper side of the coupler.

11. The switch of claim 1 further comprising a membrane layer adjacent the major spacer and covering the actuator subassembly.

12. The switch of claim 1 wherein the thickness of the major spacer is substantially the same as that of the actuator subassembly.

13. The switch of claim 12 further comprising a membrane layer adjacent the major spacer and covering the actuator subassembly.

14. The switch of claim 1 wherein the size and shape of the actuator subassembly and major spacer opening allow the subassembly to fit in the major spacer opening and engage at least a portion of the major spacer in close-fitting relation.

15. The switch of claim 14 wherein the shape of the actuator subassembly and major spacer opening are non-symmetrical.

16. The switch of claim 1 wherein the actuator subassembly further comprises a dome mounted on the platform above the cavity.

17. The switch of claim 16 further comprising a dome retainer.

18. The switch of claim 1 wherein the armature further comprises a lens portion made of a material capable of transmitting light through the armature.

19. The switch of claim 1 further comprising an aperture in the platform, and an actuating button on the armature which protrudes at least partially into the aperture, the actuating button being a lens for transmitting light through the armature and aperture.

20. The switch of claim 19 wherein the actuating button protrudes fully through the aperture and further comprising an upper spacer at least partially surrounding the aperture and actuating button.

21. The switch of claim 20 wherein the upper spacer thickness is such that it terminates in the same plane as the protruding portion of the actuating button.

22. The switch of claim 1 further characterized in that the actuator subassembly is supported solely by the substrate.

23. An electrical switch panel, comprising:

a substrate;

electrodes disposed on the substrate and defining at least first and second sets of spaced switch contacts;

first and second actuator subassemblies overlying the first and second sets of switch contacts, respectively, each actuator subassembly comprising a platform mounted on the substrate and defining a cavity adjacent the switch contacts and an electrically conductive armature disposed in the cavity, one of the platform and armature including a permanent magnet and the other being made of magnetic material such that the armature is normally held spaced from the switch contacts in engagement with the platform by the magnetic attraction between the platform and armature, the armature being releasable from the platform upon application of a switch closing force to engage and close the switch contacts.

24. The switch of claim 23 wherein the platform comprises:

a local spacer having a local opening therethrough and an upper surface; and a coupler laver mounted on the upper surface of the local spacer and at least partially overlying the local opening such that the coupler and the local spacer define the cavity at the local spacer opening.

25. The switch of claim 23 wherein the platform comprises a local spacer integrally formed with and supporting a coupler in spaced relation to the switch contacts.

26. The switch of claim 23 further comprising a major spacer mounted on the substrate and having openings which accommodate the actuator subassemblies.

27. The switch of claim 23 further comprising an aperture in the platform, and an actuating button on the armature which protrudes at least partially into the aperture.

28. The switch of claim 27 wherein the actuating button protrudes fully through the aperture and further comprising an upper spacer at least partially surrounding the aperture and actuating button.

29. The switch of claim 28 wherein the upper spacer thickness is such that it terminates in the same plane as the protruding portion of the actuating button.

30. The switch of claim 23 wherein the platform comprises:

a local spacer having a local opening therethrough and a coupler associated with the local spacer such that the coupler and the local spacer define the cavity at the local spacer opening, the coupler being made of rare earth material.

31. The switch of claim 30 wherein the local spacer and coupler are integrally formed.

* * * * *